US006616299B2

(12) United States Patent
Martineau

(10) Patent No.: US 6,616,299 B2
(45) Date of Patent: Sep. 9, 2003

(54) SINGLE OPTICAL ELEMENT LED SIGNAL

(75) Inventor: Patrick Martineau, Montreal (CA)

(73) Assignee: Gelcore LLC, Valley View, OH (US)

( * ) Notice: Subject to any disclaimer, the term of this patent is extended or adjusted under 35 U.S.C. 154(b) by 0 days.

(21) Appl. No.: 10/059,827

(22) Filed: Jan. 30, 2002

(65) Prior Publication Data

US 2002/0105801 A1 Aug. 8, 2002

Related U.S. Application Data

(60) Provisional application No. 60/266,360, filed on Feb. 2, 2001.

(51) Int. Cl.[7] ..... F21V 5/00

(52) U.S. Cl. ..... 362/244; 362/235; 362/331; 362/800; 362/545

(58) Field of Search ..... 362/545, 244, 362/800, 307, 308, 309, 235, 520, 331, 227, 543, 544

(56) References Cited

U.S. PATENT DOCUMENTS

| | | | | | |
|---|---|---|---|---|---|
| 2,191,278 | A | * | 2/1940 | Johnson | 362/309 |
| 5,062,027 | A | * | 10/1991 | Machida et al. | 362/541 |
| 5,323,302 | A | * | 6/1994 | Bertling et al. | 362/308 |
| 5,947,587 | A | * | 9/1999 | Keuper et al. | 362/235 |
| 6,352,359 | B1 | * | 3/2002 | Shie et al. | 362/522 |

* cited by examiner

*Primary Examiner*—Sandra O'Shea
*Assistant Examiner*—John Anthony Ward
(74) *Attorney, Agent, or Firm*—Orum & Roth

(57) ABSTRACT

An LED signal using a single optical element. The single optical element designed with a generally smooth outer surface and an inner surface having Fresnel optical elements in an inner center region and total internal reflection elements in an outer periphery region. The single optical element may have an integral sealing surface for sealable connection to the signal housing and no countersinking so that it is capable of manufacture by injection molding.

27 Claims, 6 Drawing Sheets

SINGLE OPTICAL ELEMENT LED SIGNAL

This application claims the benefit of U.S. Provisional Patent Application No. 60/266,360 filed Feb. 2, 2001 which is hereby incorporated by reference in its entirety.

BACKGROUND OF THE INVENTION

1. Field of the Invention

The invention relates to the field of lighting, more specifically, in a preferred embodiment, the invention relates to a Light Emitting Diode (LED) signal with a single optical element.

2. Description of the Related Art

Common incandescent lamp signals, typically have a single light source (a point source), a parabolic reflector and a distribution cover. The energy and maintenance efficiency of LED signals has resulted in their widespread adoption in place of incandescent lamps.

Previous LED signals have difficulty presenting a uniform display aspect. Individual points of light (from individual LEDs) or shadows from portions of the display aspect which are not completely covered by the LED light distribution pattern detract from uniformity (intensity homogeneity) of the prior LED signals.

As shown in FIG. 1, typical previous LED signals use a plurality of LEDs 20, a collimating/positive element/lens 5 (collimating element), and a distribution/spreading cover/window/lens 40 (distribution cover). Light emitted in a conical pattern from each of the LEDs 20 is directed towards the collimating element 5, which is often in the form of a Fresnel lens or other form of positive lens having a single, specific, focal length. That is, generally parallel light rays impinging on a first side of the lens are focused by the lens onto a single point on the other side of the lens. The collimating element 5 collects and refracts the light into a generally uniform, parallel direction (i.e. collimates the LED light output). The collimated light passes to the distribution cover 40 which is required to create a specific light distribution, spreading the narrow collimated beam of light into a desired pattern optimized for the anticipated position (s) of the viewer(s), for example pedestrians and or vehicle operators in the case of traffic signals.

Previous solutions to the intensity homogeneity problems include purposely locating the LED's at a location out of focus with respect to a focal length of a collimating positive lens. However, designing the signal to be "out of focus" causes a light output design loss. Alternatively, the LEDs may be located at an increased distance from the optical elements in a pattern where each of their light outputs overlap. The increased distance between the optical element and the LEDs allows the light emitted by the LEDs to fully cover the optical elements. Increasing the distance between the LEDs and the optical elements requires a deeper housing which may frustrate use of the LED signal in retrofit applications to existing incandescent housings and adds materials costs compared to a shallower housing.

In order to meet existing signal standards and/or allow retrofitting into signals originally manufactured for use with incandescent light sources, LED signals mimic the front housing diameter and depth restrictions of the prior incandescent signals. To allow use of large diameter Fresnel lenses as the collimating element 5 without requiring an overly deep housing, previous signals use a collimating element configured with outward facing features 15. Because dirt will accumulate on the outward facing features of an exposed collimating element and degrade light output, a distribution cover with a generally smooth outer surface was required on the previous solutions to seal the collimating element from the environment even if creation of a light distribution pattern other than the narrow collimated light was not important.

Each additional optical element introdeces a light transmission loss and adds extra matrerials and assembly costs. It is an objective of the present invention to solve these and other problems that will become apparent to one skilled in the art upon review of this specification.

SUMMARY OF THE INVENTION

Light transmission losses, materials and assembly costs are minimized by using only a single optical element. One or more LEDs are clustered to create a light emission zone which illuminates a single optical element that forms the desired final light distribution pattern specific to the anticipated application of the signal. The aggregate light from the light emission zone is transformed by the single optical element into a desired final display aspect. The single optical element uses Fresnel elements in regions close to the center of the optical element and total internal reflection elements towards the outer periphery of the optical element. Both the Fresnel and the total internal reflection elements are formed on the inner face of the single optical element. The outer surface of the single optical element is designed so that features, for example diffusion patterns, thereon on which dirt accumulation may occur are minimized or eliminated.

BRIEF DESCRIPTION OF THE DRAWINGS

Several embodiments of the present invention are described with the aid of the following figures.

DETAILED DESCRIPTION

Applicant's U.S. patent application Ser. No. 09/756,670 now U.S. Pat. No. 6,509,840 titled "Sun Phantom LED Traffic Signal" filed Jan. 10, 2001, and application Ser. No. 09/827,429 titled "LED Light Degradation Sensing Signal with Light Pipe Collector" filed Apr. 6, 2001, are hereby incorporated by reference in their entirety.

Figure 1:
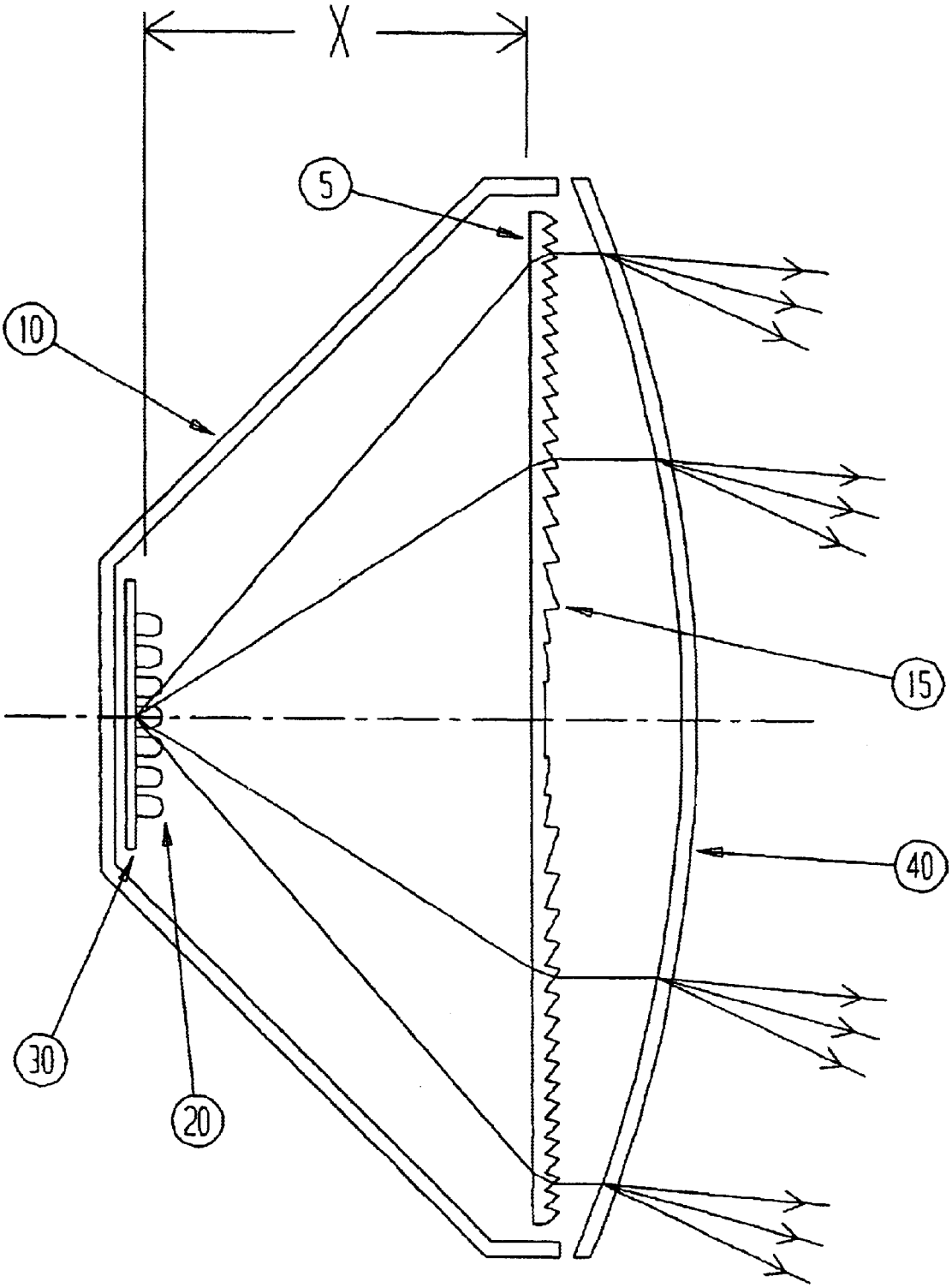
FIGURE 1 PRIOR ART
FIG. 1 is a cut-away side view of a typical Prior Art LED signal with multiple optical elements.
Figure 2:
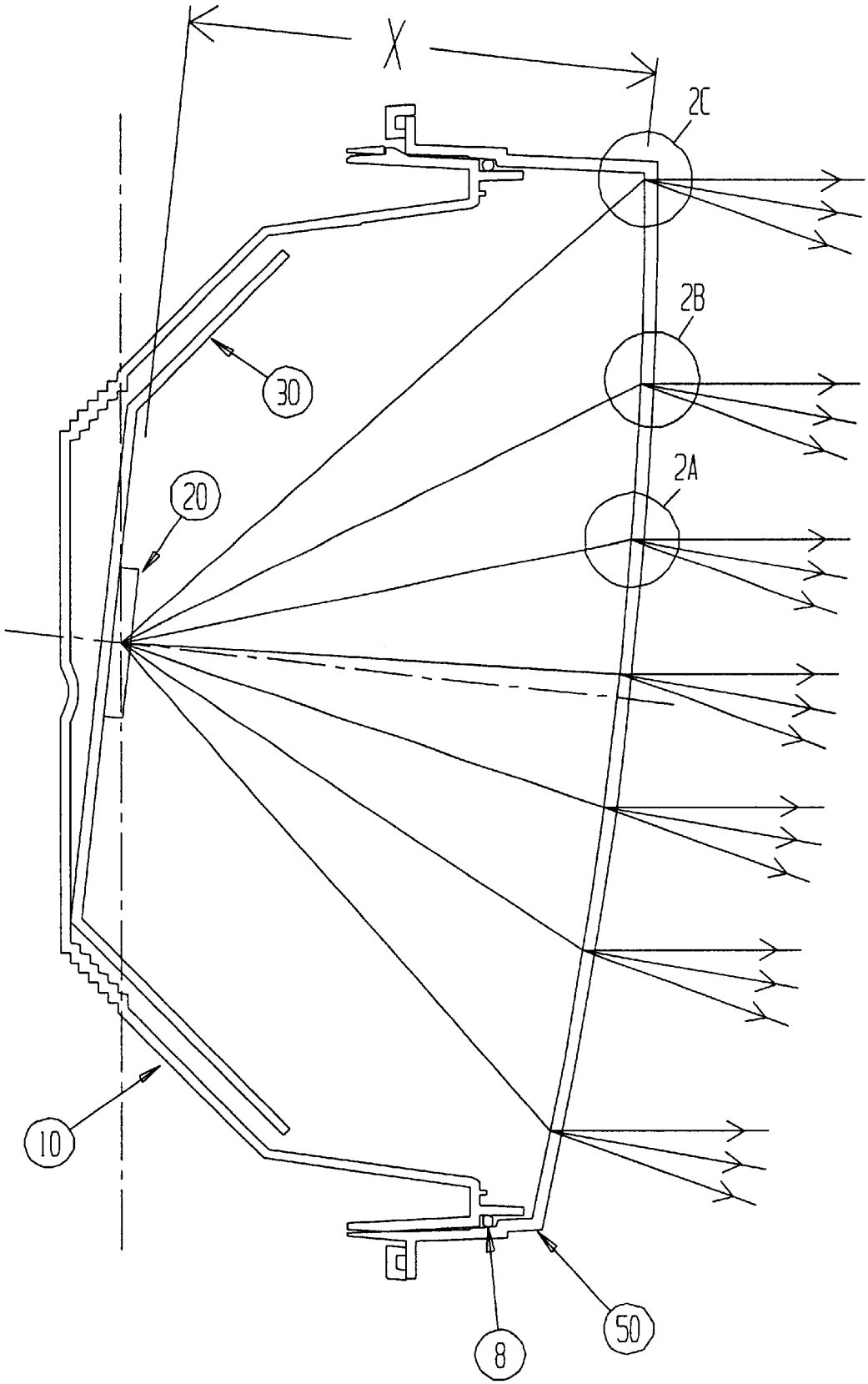
FIG. 2 is a cut-away side view of an LED signal according to one embodiment of the present invention.

A first embodiment in the form of an LED signal is shown in FIG. 2. For clarity, electronic components comprising, for example, a power supply and or fault indication circuitry are omitted. A housing 10 contains one or more light sources, for example LED(s) 20. The housing 10 is sealed by a sealing surface of the single optical element (SOE) 50. To improve the seal, an o-ring 8 may be included between the housing and the single optical element 50. The seal between the housing 10 and the SOE 50 providing environmental isolation for the inside of the LED signal. Where multiple LEDs are used to generate the desired light output level, the LEDs are clustered together in a concentrated light emission zone. Clustering of the LEDs into a zone simplifies the optical design of the SOE 50. Clusters having an area 30% or less than the area of the SOE 50 are preferred. Where use as an overhead signal is intended, the plane of the light emission zone may be angled with respect to the backplane of the housing to assist in directing the light output in a downwards direction and to assist with sun phantom minimization in concert with a similar angle of the single optical element 50. The LED(s) 20 are mounted on a printed circuit board (PCB) and/or a heat sink 30.

The SOE 50, preferably constructed of a light transmissive material, such as an acrylic, polycarbonate or other optically acceptable quality and/or cost effective material has an optical design which combines the functions of the prior collimating element 5 and the distribution cover 40. Preferably, the outer surface of the SOE 50 is generally smooth so that opportunities for dirt buildup on the outer surface are minimized. A textured surface may be utilized as a means for diffusing the signals display aspect to obscure any imperfections/design losses/shadows in the optical solution.

Figure 2A:
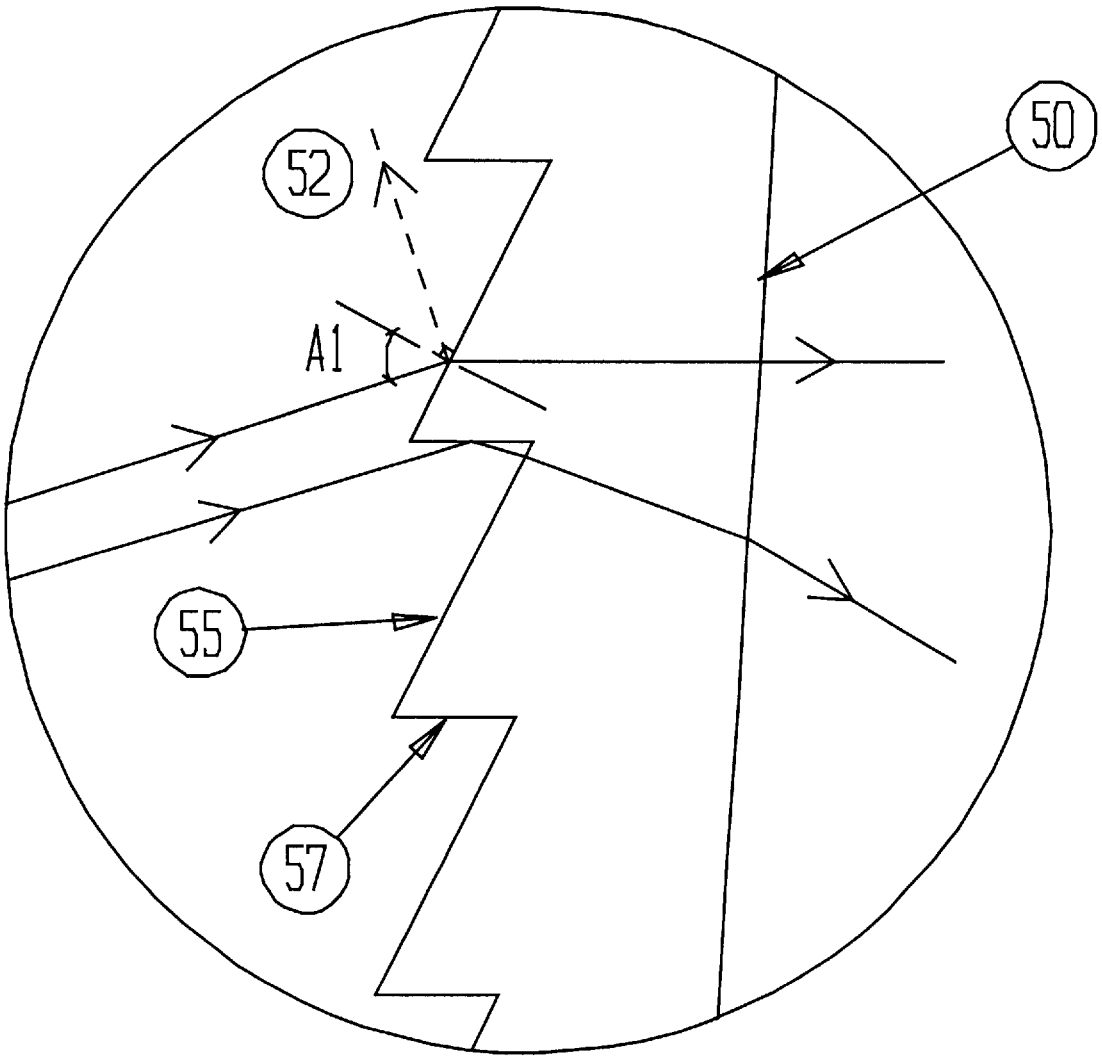
FIG. 2A is a close-up of area 2A of FIG. 2.
Figure 2B:
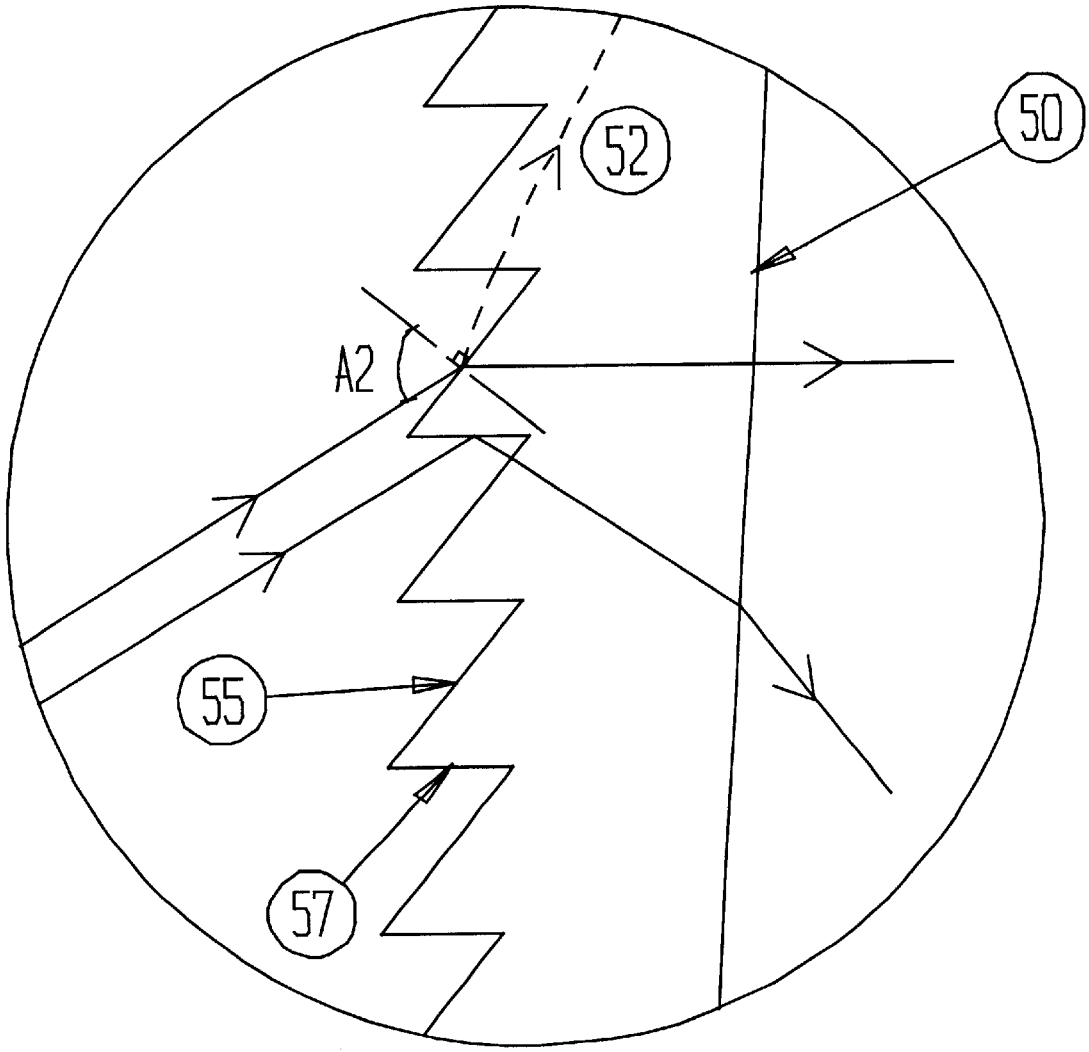
FIG. 2B is a close-up of area 2B of FIG. 2.

On the inside surface of the SOE 50, from the approximate center to the outer periphery, patterns of optical features are used to receive the light emitted by the LED(s) 20 and redirect it into a desired light distribution pattern. As shown in FIGS. 2A and 2B, where the angle of incidence (A1, A2) upon the SOE 50 permits, Fresnel elements comprising Fresnel 55 and edge 57 entry faces may be used. Light rays incident upon the Fresnel 55 entry faces are refracted to a desired direction while the light rays incident on the edge 57 entry faces are refracted to undesired directions and treated as design losses. A portion of the light incident upon the Fresnel entry faces 55 also reflects as shown by ray 52. The Fresnel elements located farther and farther from the normal to the center of the light source have corresponding angle of incidence increases as shown, for example in FIG. 2B. As the angle of incidence increases, the ratio of Fresnel 55 to edge 57 entry faces increases along with the associated design losses and an increasing portion of light reflecting as ray 52. When the angle of incidence increases to a point where design losses pass an acceptable level, a switch to optical features utilizing total internal reflection is made.

Figure 2C:
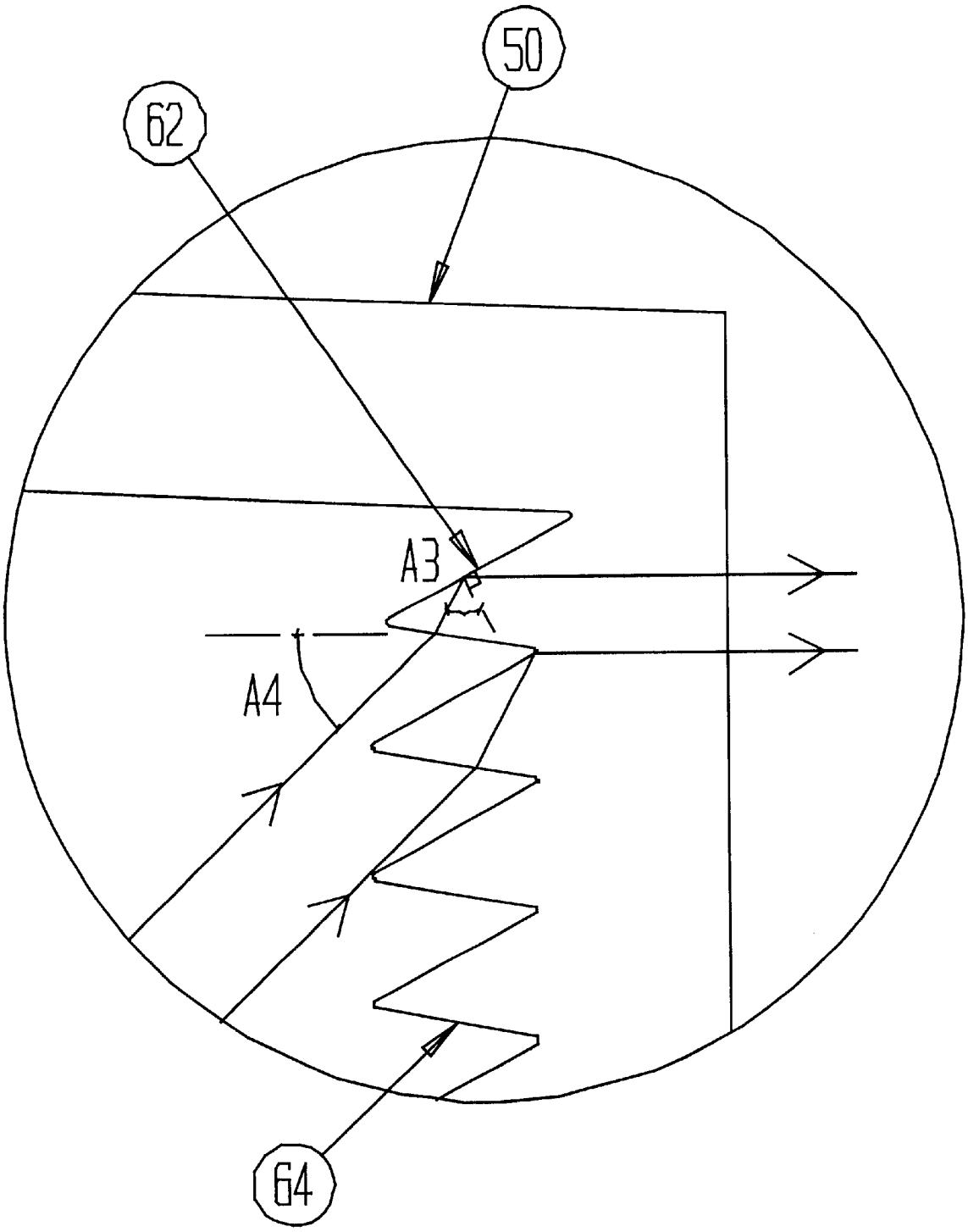
FIG. 2C is a close-up of area 2C of FIG. 2.

Total internal reflection optical features, as shown in FIG. 2C, have an entry face 64, and a total internal reflection (TIR) face 62. For example purposes, polycarbonate material has a critical angle of 38.9°. As long as the incident light ray is designed to be at an angle A3 of more than 38.9° with respect to a normal to the TIR face 62 and the outer surface of the TIR face 62 is surrounded by air, or other medium of equal or lesser density than air, total internal reflection will occur. Total internal reflection removes any requirement that the reflector surfaces be mirror coated.

The distance X (FIG. 2) between the LED(s) 20 and the SOE 50 directly affects the angles of incidence across the SOE 50 from center to periphery. A shorter distance X enables overall housing 10 depth to be minimized, allowing reductions in materials costs and retrofitting of the signal into housings originally intended for incandescent light sources. Depending upon the distance X, the location of the transition between Fresnel and TIR optical features will be changed with TIR optical features starting closer to center with shorter distances X.

At extreme angles of incidence A4 with respect to the light source, the entry face 64 begins to create a shadow on the entry face 64 next in line towards the periphery. As the proportion of shadow increases past an acceptable level, the maximum angle of incidence A4 is limited, thereby defining the minimum distance X that may be used with a specific SOE 50 diameter. A ratio of the Fresnel diameter to the distance X of up to 3 may be achieved. For example, a standard 12 inch diameter signal may have a light emission zone at a distance X of 4 inches from the SOE 50. Where depth is not a constraint, ratios as low as 0.5 may be used. Below this point, an all Fresnel SOE 50 may be used, eliminating the need for the TIR optical features.

Figure 3:
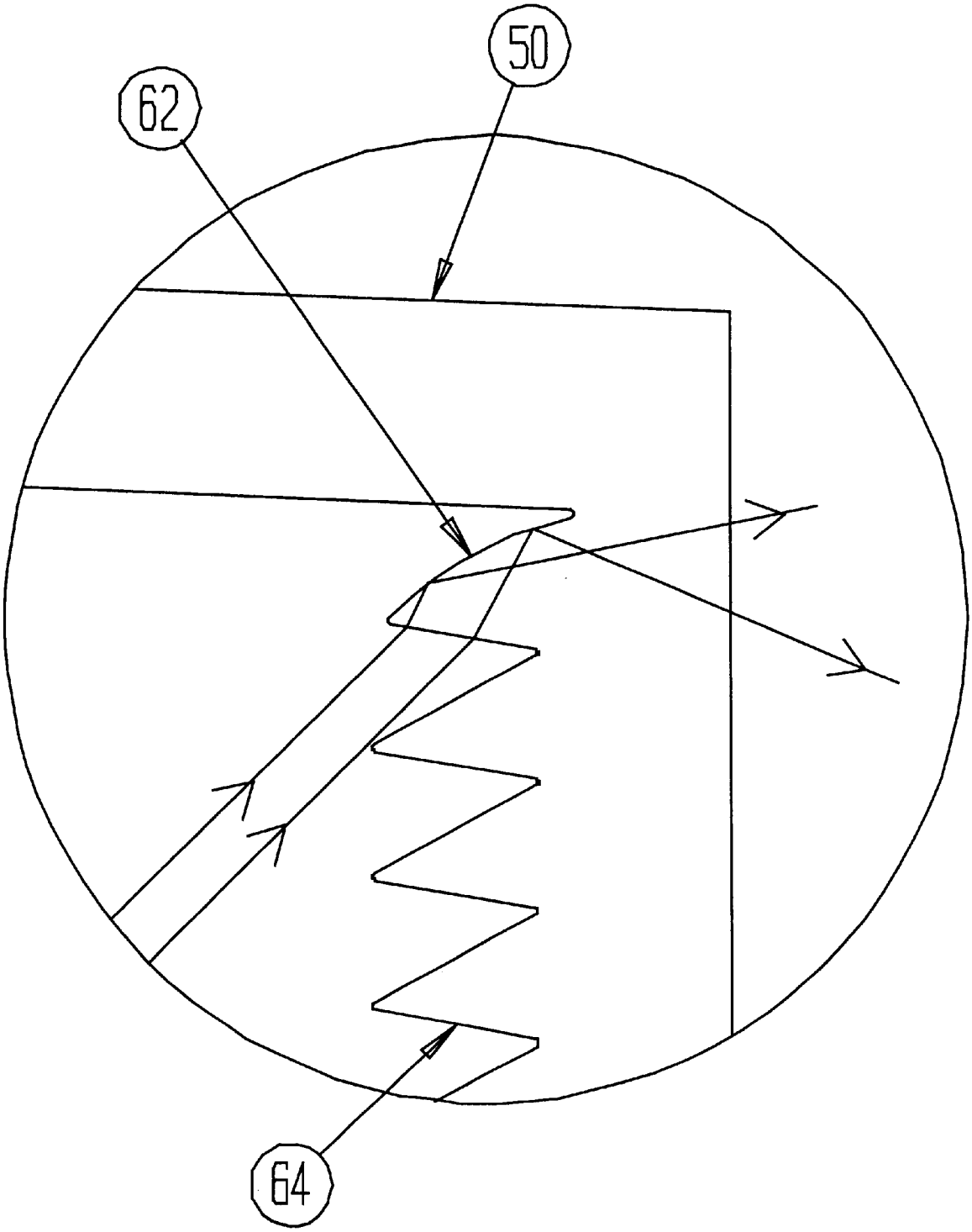
FIG. 3 is an alternate embodiment of FIG. 2C, showing a curved total internal reflection face.

Shadows may be compensated for by forming the TIR face 62 in a curve, as shown in FIG. 3, to redirect a portion of the reflected light into any shadow region that may be present (at the desired viewing distance).

Depending upon the location of each optical feature, the specific angles of each Fresnel and or TIR optical feature is calculated to re-direct the average incident light ray (the light rays each coming from different points of each LED in the light emission zone) into the desired direction, within the bounds of the type of optical feature applied. Curved TIR 62 and or Fresnel 55 faces may also be used in configuring the light output through the SOE 50 into the precise desired final light distribution. Optical raytracing engineering software may be used to assist with calculating the exact optical surface characteristics that deliver the desired light distribution for the LED signal.

In order to further minimize manufacturing costs, the SOE 50 may be designed to be capable of manufacture by injection molding. Use of two part injection molds requires that the optical surfaces and SOE 50 to housing 10 contact and sealing surfaces be designed free of countersinking to allow mold separation.

In other embodiments, the SOE 50 according to the invention is not limited to signals utilizing only conventional LED(s). For example, multiple LED dies may be combined into a single encapsulated LED package with or without an integrated heatsink.

To create a desired signal color, LED's 20 of different colors may be used with a single optical element 50 that is clear. Alternatively, the single optical element 50 may be formed from different colored or tinted material, for example, white, red, yellow and green.

Although particular components and materials are specifically identified herein, one skilled in the art may readily substitute components and/or materials of similar function without departing from the invention as defined in the appended claims.

The present invention is entitled to a range of equivalents, and is to be limited only by the following claims.

I claim:

1. An LED signal lamp comprising:

a housing, having an open end;

at least one light emitting diode;

a single optical element with optical features on an inner face and a substantially smooth outer face, the inner face having a center zone and a periphery zone and the optical elements in the center zone comprise a plurality of Fresnel elements and the optical elements in the periphery zone comprise a plurality of total internal reflection elements, wherein at least one of the total internal reflection elements has a shaped face;

the single optical element having an area;

the housing enclosing the at least one light emitting diode(s); and the single optical element covering the open end of the housing.

2. The signal of claim 1, wherein:

the at least one light emitting diode is a plurality of light emitting diodes located in a cluster covering a second area; and the second area is 30% or less than the area of the single optical element.

3. The signal of claim 1, wherein:

the at least one light emitting diode is at least one encapsulated LED package containing more than one LED die.

4. The signal of claim 1, wherein:

the at least one light emitting diode is a plurality of light emitting diodes clustered together on a planar surface, the planar surface is oriented at an angle with respect to a back plane of the housing, and the single optical element outer face is oriented at a second angle with respect to the back plane of the housing.

5. The signal of claim 4, wherein:

the planar surface is a heat sink.

6. The signal of claim 1, wherein:

the single optical element is formed with a sealing surface which mates with the housing to create seal between the single optical element and the housing.

7. The signal of claim 6, further including:

an o-ring located between the sealing surface and the housing.

8. The signal of claim 1, wherein:

the ratio of a diameter of the single optical element to a distance between the single optical element and the at least one LED is between 0.5 and 3.

9. The LED signal lamp of claim 1 wherein the shaped face is curved on at least one axis.

10. The LED signal lamp of claim 9 wherein the shaped face is curved on at least two axes.

11. The LED signal lamp of claim 1 wherein all of the total internal reflection elements have a shaped face curved on at least one axis.

12. The LED signal lamp of claim 1 wherein the shaped face is curved to control the light distribution on the horizontal and/or vertical axis.

13. The LED signal of claim 12 wherein the shaped face is curved on at least one axis.

14. The LED signal of claim 13 wherein the shaped face is curved on at least two axes.

15. The optical element of claim 12 wherein the shaped face is are curved on at least two axes.

16. The optical element of claim 12 wherein a plurality of the total internal reflection elements have a shaped face curved on at least one axis.

17. The optical element of claim 12 wherein all of the total internal reflection elements have a shaped face curved on at least one axis.

18. An optical element for use in a LED signal, comprising:

a light transmissive element having a front and a back surface, the front surface being substantially smooth, the back surface populated with a plurality of optical elements in a center zone and a periphery zone, the optical elements in the center zone including a plurality of Fresnel elements; and the optical elements in the periphery zone including a plurality of total internal reflection elements, wherein at least one of the total internal reflection elements has a shaped face.

19. The optical element of claim 18, wherein:

the front surface has a diffusion pattern.

20. The optical element of claim 18, wherein:

the total internal reflection and Fresnel elements are configured without countersinking.

21. The optical element of claim 18, further including:

a sealing surface on an outer periphery.

22. The optical element of claim 18, wherein:

the optical element is one of clear, white, red, yellow and green.

23. The optical element of claim 18 wherein the shaped face is curved on at least one axis.

24. The optical element of claim 18 wherein the shaped face is curved to control the light distribution on the horizontal and/or vertical axis.

25. The optical element of claim 24 wherein the shaped face is curved on at least one axis.

26. The optical element of claim 25 wherein the shaped face is curved on at least two axes.

27. The optical element of claim 24 wherein a plurality of the total internal reflection elements have a shaped face curved on at least one axis to control the light distribution on the horizontal and/or vertical axis.

* * * * *